US006020073A

United States Patent [19]

Wilson, Sr.

[11] Patent Number: 6,020,073

[45] **Date of Patent: *Feb. 1, 2000**

[54] PAVEMENT MARKING MATERIAL AND METHOD OF PAVEMENT MARKING

[76] Inventor: Jack H. Wilson, Sr., 4654 Hickory Ridge Rd., Jackson, Miss. 39211

[ * ] Notice: This patent issued on a continued prosecution application filed under 37 CFR 1.53(d), and is subject to the twenty year patent term provisions of 35 U.S.C. 154(a)(2).

[21] Appl. No.: 08/845,845

[22] Filed: Apr. 28, 1997

[51] Int. Cl.[7] ..... E01C 7/35

[52] U.S. Cl. ..... 428/489; 428/325; 428/339; 428/172; 404/12; 404/17

[58] Field of Search ..... 106/696, 822, 106/724, 737, 823; 428/489, 325, 339, 172; 404/12, 17

[56] References Cited

U.S. PATENT DOCUMENTS

| | | | |
|---|---|---|---|
| 3,874,140 | 4/1975 | Seehusen | 52/315 |
| 3,993,412 | 11/1976 | Drane | 404/28 |
| 4,020,211 | 4/1977 | Eigenmann . | |
| 4,172,063 | 10/1979 | O'Brill | 260/29.6 S |
| 4,265,957 | 5/1981 | Severence . | |
| 4,367,300 | 1/1983 | Aoki et al. | 524/2 |
| 4,392,335 | 7/1983 | Heiman . | |
| 4,436,845 | 3/1984 | Kitano . | |
| 4,959,250 | 9/1990 | McKinnon | 428/15 |
| 5,021,476 | 6/1991 | Pinomaa | 524/77 |
| 5,422,162 | 6/1995 | Passarino et al. | 427/143 |
| 5,472,737 | 12/1995 | Anders | 427/137 |
| 5,502,941 | 4/1996 | Zember et al. | 52/314 |

FOREIGN PATENT DOCUMENTS

| | | |
|---|---|---|
| 62-32333 | 8/1988 | Japan . |
| 01236283 | 9/1989 | Japan . |

*Primary Examiner*—Shrive Beck
*Assistant Examiner*—Michael Barr
*Attorney, Agent, or Firm*—Merek & Voorhees

[57] ABSTRACT

A substantially permanent pavement marking system using a polymer modified cement material to provide a raised marking that extends above the surface of the pavement. The lines are formed by taping off the desired outline shape of the marking. The pavement marking material is of such a consistency that it will set up to form a thick layer and not flow over the tape and will harden forming a raised marking.

6 Claims, 2 Drawing Sheets

PAVEMENT MARKING MATERIAL AND METHOD OF PAVEMENT MARKING

FIELD OF THE INVENTION

The present invention relates to material for placing permanent markings on pavement and method of marking pavement for traffic control.

BACKGROUND OF THE INVENTION

Pavement markings currently are applied in the form of arrows, lane dividers, parking lot striping and special designations such as handicap parking and are usually applied using paint applied directly to the pavement surface. These markings generally are required to be repainted every year or more often depending on traffic volume and weather conditions. An additional problem with painting on pavement and particularly on asphalt is that the heating and cooling effect of the black asphalt surface is uneven due to the light reflective nature of white or yellow striping. This uneven heating effect tends to cause cracking along the striped area thus permitting water to enter the crack and further degrading the asphalt surface during freezing and thawing conditions.

An alternative to painting has been the use of tape using an adhesive to adhere the striping to the pavement surface. However, taping is also not a permanent solution as the adhesive tends to degrade due to weather conditions and heat and can become detached from the pavement surface.

In view of the foregoing, it can be seen that there is a need for a new pavement marking system which achieves a permanent pavement marking and eliminates a need for annual repainting of pavement markings.

SUMMARY OF THE INVENTION

The present invention provides a permanent pavement marking system through the use of a polymer modified cement material to provide a raised marking that extends above the surface of the pavement. The lines are formed by taping off the desired outline shape of the marking. The pavement marking material is of such a consistency that it will set up to form a thick layer and not flow over the tape and will harden forming a raised marking. Accordingly, it is an object of the invention to provide a pavement marking material formed of polymer modified cement.

Another object of the invention is to provide a method of pavement marking to form substantially permanent pavement markings.

Other objects, uses and advantages will be apparent from a reading of this description which proceeds with reference to the accompanying drawings forming a part thereof.

DETAILED DESCRIPTION OF THE DRAWINGS

DESCRIPTION OF THE PREFERRED EMBODIMENT

This invention will flow be described by way of example only with reference to the accompanying drawings. It should be appreciated however that modifications and improvements may be made to the invention without departing from the spirit thereof. The present invention provides a method of applying substantially permanent pavement markings through the use of a polymer modified cement. In general, the pavement marking material is made of three parts heavy grade sand to one part cement mix and one part resin which is preferably ROHM and HAAS 330 acrylic resin or UNICAL 651 resin. For example, in the nonpigmented version a ready made sand topping mix such as QuickKrete may be mixed with the resin described above and a 20–40 mesh sand particle using approximately one gallon resin and a sixty pound bag of sand topping mix with one quart of water. For a pigmented line, white cement and white sand would be used along with a soluble coloring agent for example titanium dioxide for white and chromium for yellow pigment.

Figure 1:
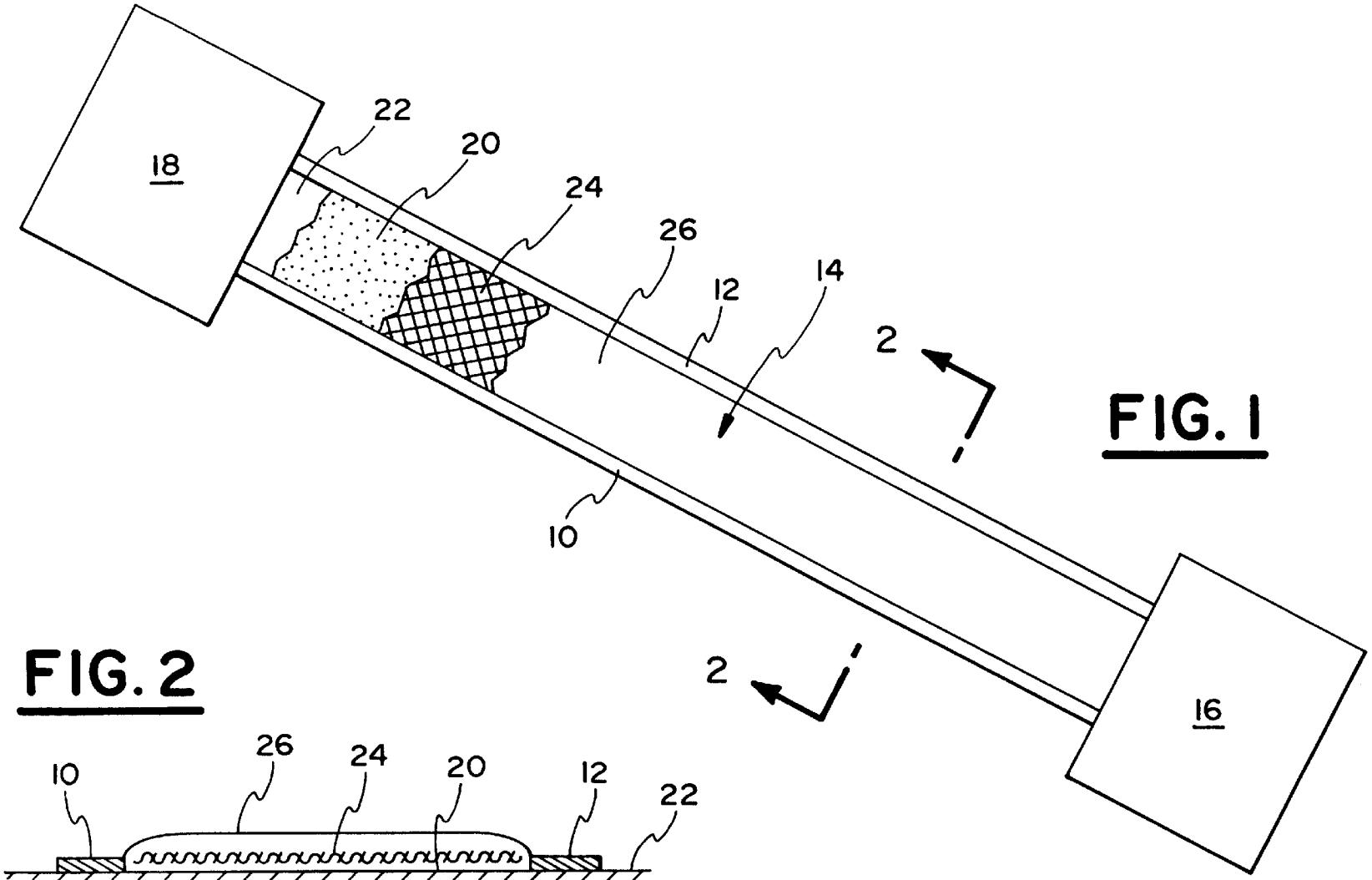
FIG. 1 is a top view of an outlined pavement marking.

Application of the marking material is as follows: First, the existing lines must be cleaned thoroughly by removing all grease, dirt or peeling paint. Next and now with reference to FIG. 1, the borders of the area to be marked are formed by strips of tape 10 and 12. It should be noted that a commercial pavement tape should be used in order to provide proper adhesion to asphalt because hot pavement rejects most tape. Tape borders 10 and 12 are applied using a tape machine (not shown) or may be applied by hand. Further, tape should be placed perpendicularly on the marked area 14 so that the ends of the marked area 14 will be square. Further, it is preferable that one foot by two foot rubber pads 16,18 should be placed at either end of the marked area to create a starting area and an ending area for excess material. In forming a parking space line as shown by the marked area 14 in FIG. 1, preferably a layer of acrylic material 20 is laid over the pavement 22 filling the space 14 between the tape lines 10 and 12. Preferably, when cracking is present in the pre-existing pavement a layer of fiberglass tape 24 is laid on top of the acrylic polymer material and is then saturated with additional acrylic polymer material. Next the acrylic polymer material 20 which has been saturated onto and into the fiberglass tape 24 should be allowed to dry. Next the cement material 26 is poured over the marked area 14. The polymer modified cement 26 will be of a consistency or viscosity such that it will build up but not flow across the tape borders 10 and 12.

Figure 2:
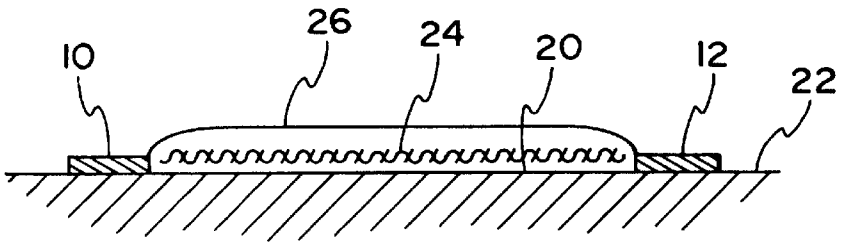
FIG. 2 is a cross sectional view of the line marking of FIG. 1 taken along lines 2—2 of FIG. 1.
Figure 3:
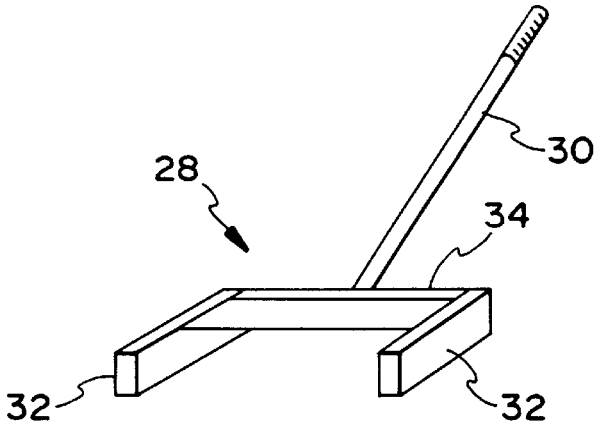
FIG. 3 is a perspective view of a line screed.
Figure 4:
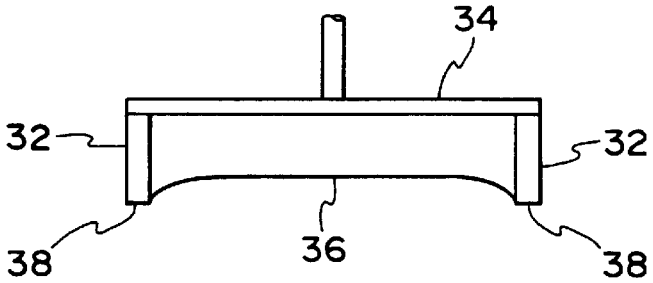
FIG. 4 is a rear view of the line screed of FIG. 4.

Now referring to FIG. 2, it is shown the tapes 10 and 12 on pavement 22 therebetween is the slightly mounded polymer modified cement 26 showing a build-up of approximately one eighth of an inch. It should be understood that the height may be varied as desired, but a one eighth of an inch height is effective to have the advantage of impeding shopping carts from freely rolling across parking lots, but yet not be so high as to cause pedestrians to trip over the lines. In order to provide a uniform height to the polymer modified cement layer 26, a line screed 28 as shown in FIGS. 3 and 4 is used. As can be seen in FIG. 3, the line screed 28 has a handle 30, a pair of side members 32 and a cross member 34. Now with reference to FIG. 4, which is a rear view of line screed 28 of FIG. 3, the cross member 34 is shown having an arched surface 36 extending upwardly from the bottom edges 38 of side members 32. Side members 32 hold the material within a three sided box 40 formed by cross member 34 and side members 32. As the line screed 28 is pushed down the marked area 14, side members 32 will substantially rest on tapes 10 and 12 and the arched surface 36 of cross member 34 forms an arched shape along length of the marked area 14 and provides uniformity along its length. Any excess material will be deposited on one of the rubber pads 16,18 at the ends of the marked area 14.

Figure 5:
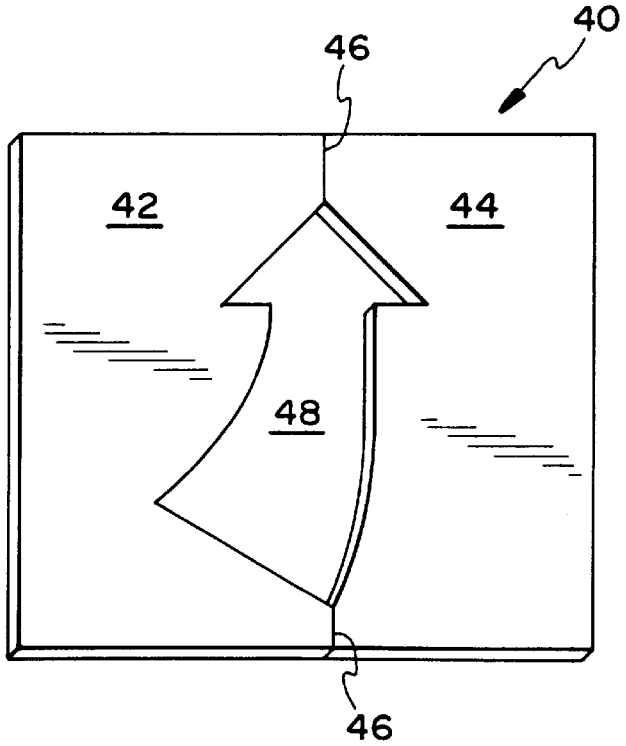
FIG. 5 is a perspective view of a stencil mat for use in marking pavement.

When marking pavement with arrows or handicap indicia a stencil mat 40 as shown in FIG. 5 is preferably used. Stencil mat 40 is preferably formed of one-eighth inch rubber. Stencil mat 40 is formed of two halves 42 and 44 divided by a seam 46. A portion of mat 40 is removed to create, for example, a directional arrow form 48 in FIG. 5.

To form a pavement marking, polymer modified cement is poured into the arrow form 48 and a rubber squeegee (not shown) is dragged across stencil 40 to push excess material outside arrow form 48 and is deposited onto mat 40. Then the halves 42, 44 are pulled apart and removed leaving the newly formed pavement marking.

If nonpigmented polymer modified concrete is used to form the lines, the concrete may be colored through the use of a colored sealer applied after the concrete is dried. The colored sealer soaks into the concrete creating a permanent color. In any event a sealant is preferably applied to the dried concrete. Further, reflective agents such as glass beads may be imbedded in the concrete pavement marking to enhance nighttime visibility.

It should be understood that the raised lines as described are only by way of example in the context of lines of a parking lot which have the added advantage of reducing runaway shopping carts by impeding the movement of shopping carts down the parking lot. However, the pavement marking material and method as described may also be used to create arrows or dividing lines or speed bumps or other pavement indicia.

While this invention has been described as having a preferred design, it is understood that it is capable of further modifications, uses and/or adaptions of the invention following in general the principle of the invention and including such departures from the present disclosure as come within the known or customary practice in the art to which the invention pertains and as maybe applied to the central features hereinbefore set forth, and fall within the scope of the invention and the limits of the appended claims.

What is claimed is:

1. A marked pavement surface comprising:

a) a paved asphalt surface;

b) a polymer modified cement marking compound formed on said paved asphalt surface to mark said surface with pavement indicia;

c) said marking compound having a mixture of acrylic resin, sand, cement and water of such consistency that it will set up before substantial spreading can occur and harden to form a raised marking;

d) a colored sealer layer formed over said polymer modified cement marking compound which soaks into said marking compound thereby permanently coloring said marking compound.

2. The marked pavement surface as set forth in claim 1 wherein:

a) said marking compound further including reflective agents to enhance nighttime visibility.

3. The marked pavement surface as set forth in claim 1 wherein:

a) said sand is white sand and said cement is white cement.

4. The marked pavement surface as set forth in claim 1, wherein:

a) said colored sealer is white.

5. The marked pavement surface as set forth in claim 1 wherein:

a) said colored sealer is yellow.

6. The marked pavement surface as set forth in claim 1, wherein:

a) said raised marking extends approximately one-eighth of inch above said asphalt layer.

* * * * *